US010323406B2

(12) United States Patent
Hansort

(10) Patent No.: US 10,323,406 B2
(45) Date of Patent: Jun. 18, 2019

(54) FLOOR DOWEL SLEEVE FOR CONCRETE SLAB SEAMS

(71) Applicant: Midwest Concrete & Masonry Supply, Inc., Naperville, IL (US)

(72) Inventor: Marinus Hansort, St. Pete Beach, FL (US)

(73) Assignee: Midwest Concrete & Masonry Supply, Inc., Naperville, IL (US)

( * ) Notice: Subject to any disclaimer, the term of this patent is extended or adjusted under 35 U.S.C. 154(b) by 0 days.

(21) Appl. No.: 15/869,799

(22) Filed: Jan. 12, 2018

(65) Prior Publication Data

US 2018/0202145 A1 Jul. 19, 2018

Related U.S. Application Data

(60) Provisional application No. 62/446,704, filed on Jan. 16, 2017.

(51) Int. Cl.

| | |
|---|---|
| ***E01C 11/14*** | (2006.01) |
| ***E04B 1/41*** | (2006.01) |
| ***E04B 1/48*** | (2006.01) |
| ***E04B 5/32*** | (2006.01) |
| ***E04B 5/02*** | (2006.01) |

(52) U.S. Cl.

CPC ..... *E04B 1/4114* (2013.01); *E04B 1/483* (2013.01); *E04B 5/023* (2013.01); *E04B 5/32* (2013.01); *E04B 2005/324* (2013.01); *E04B 2103/02* (2013.01)

(58) Field of Classification Search

CPC . E04B 1/483; E04B 1/48; E01C 11/14; E01C 19/504

See application file for complete search history.

(56) References Cited

U.S. PATENT DOCUMENTS

| | | | |
|---|---|---|---|
| 2,096,702 | A | 10/1937 | Yeoman |
| 2,194,718 | A | 3/1940 | Older |
| 2,305,979 | A | 12/1942 | Mitchell |
| 2,476,243 | A | 7/1949 | Heltzel |

(Continued)

FOREIGN PATENT DOCUMENTS

EP 1389648 B1 1/2007

OTHER PUBLICATIONS

PNA Construction Technologies, Inc., Diamond Dowel System, 2010.

(Continued)

*Primary Examiner* — Gisele D Ford
(74) *Attorney, Agent, or Firm* — Honigman LLP

(57) ABSTRACT

A floor dowel sleeve is provided that includes a rectangular-shaped body portion having a cavity that is configured to receive a dowel plate that spans across a seam between concrete slabs. A pair of break-away interior walls extend within the cavity from the opening to the end wall of the sleeve. The interior walls extend between two opposing (horizontal) walls of the exterior side walls and are continuously spaced from the other two opposing (vertical) walls of the exterior side walls. The body portion is configured to receive the dowel plate in the cavity between the break-away interior walls, where the break-away interior walls are configured to at least partially break-away from the exterior side walls upon lateral horizontal movement of the dowel plate within the cavity.

21 Claims, 6 Drawing Sheets

(56) References Cited

U.S. PATENT DOCUMENTS

| | | | | |
|---|---|---|---|---|
| 3,559,541 | A | 2/1971 | Watstein | |
| 5,005,331 | A | 4/1991 | Shaw et al. | |
| 5,216,862 | A | 6/1993 | Shaw et al. | |
| 5,344,251 | A * | 9/1994 | Erb | E04F 11/022 403/220 |
| 5,618,125 | A | 4/1997 | McPhee et al. | |
| 5,674,028 | A * | 10/1997 | Norin | E01C 11/14 404/60 |
| 5,678,952 | A | 10/1997 | Shaw et al. | |
| 5,713,174 | A | 2/1998 | Kramer | |
| 5,797,231 | A | 8/1998 | Kramer | |
| 5,934,821 | A | 8/1999 | Shaw et al. | |
| 5,941,045 | A | 8/1999 | Plehanoff et al. | |
| D419,700 | S | 1/2000 | Shaw et al. | |
| 6,145,262 | A | 11/2000 | Schrader et al. | |
| 6,354,760 | B1 | 3/2002 | Boxall et al. | |
| D459,205 | S | 6/2002 | Shaw et al. | |
| 6,502,359 | B1 | 1/2003 | Rambo | |
| 6,692,184 | B1 | 2/2004 | Kelly et al. | |
| 6,758,023 | B1 | 7/2004 | Sorkin | |
| 6,926,463 | B2 | 8/2005 | Shaw et al. | |
| 7,004,443 | B2 * | 2/2006 | Bennett | E01C 11/14 249/177 |
| 7,314,333 | B2 | 1/2008 | Shaw et al. | |
| 7,338,230 | B2 | 3/2008 | Shaw et al. | |
| 7,381,008 | B2 | 6/2008 | Shaw et al. | |
| 7,441,985 | B2 | 10/2008 | Kelly et al. | |
| 7,481,031 | B2 | 1/2009 | Boxall et al. | |
| 7,604,432 | B2 | 10/2009 | Shaw et al. | |
| 7,736,088 | B2 | 6/2010 | Boxall et al. | |
| 7,748,928 | B2 | 7/2010 | Estes et al. | |
| 7,967,527 | B2 | 6/2011 | Estes et al. | |
| 8,465,222 | B1 | 6/2013 | Ghauch et al. | |
| 8,672,579 | B2 | 3/2014 | Laiho et al. | |
| 9,340,969 | B1 | 5/2016 | Shaw | |
| 2005/0036835 | A1 * | 2/2005 | Shaw | E01C 11/14 404/51 |
| 2005/0214074 | A1 | 9/2005 | Shaw et al. | |
| 2006/0140721 | A1 * | 6/2006 | Shaw | E01C 11/14 404/60 |
| 2006/0182496 | A1 * | 8/2006 | Shaw | E01C 11/14 404/56 |
| 2006/0275078 | A1 | 12/2006 | Shaw et al. | |
| 2007/0231068 | A1 | 10/2007 | Francies et al. | |
| 2007/0269266 | A1 * | 11/2007 | Kelly | E01C 11/14 404/56 |
| 2008/0014018 | A1 * | 1/2008 | Boxall | E01C 11/14 404/56 |
| 2009/0035063 | A1 * | 2/2009 | Estes | E01C 11/14 404/52 |
| 2010/0054858 | A1 | 3/2010 | Mayo et al. | |
| 2010/0313518 | A1 * | 12/2010 | Berg | E04B 1/215 52/707 |
| 2015/0197898 | A1 | 7/2015 | Shaw | |
| 2015/0204026 | A1 | 7/2015 | McDonald | |
| 2016/0083914 | A1 | 3/2016 | Shaw | |
| 2016/0222600 | A1 | 8/2016 | Shaw | |

OTHER PUBLICATIONS

Greenstreak Group, Inc., You have a Choice!, 2010.
PNA Construction Technologies, Inc, $PD^3$ Basket Assembly, 2010.
PNA Construction Technologies, Inc., Square Dowel and Clip, 2010.
PNA Construction Technologies, Inc., Diamond Dowel System, Jan. 2010.
Greenstreak Group, Inc., You have a Choice!, Mar. 2010.
PNA Construction Technologies, Inc, $PD^3$ Basket Assembly, Jan. 2010.
PNA Construction Technologies, Inc., Square Dowel and Clip, Jan. 2010.

* cited by examiner

FLOOR DOWEL SLEEVE FOR CONCRETE SLAB SEAMS

CROSS-REFERENCE TO RELATED APPLICATION

The present application claims the filing benefit of U.S. Provisional Application, Ser. No. 62/446,704, filed Jan. 16, 2017, which is hereby incorporated herein by reference in its entirety.

FIELD OF THE INVENTION

The present invention generally relates to pockets or sleeves for concrete reinforcements and related seam reinforcement assemblies that extend between adjacent concrete slabs, and more particularly to dowel sleeves that are cast into edges of concrete slabs for receiving dowel plates or bars or the like.

BACKGROUND OF THE INVENTION

It is relatively common to reinforce the seams between concrete floor slabs to prevent the slabs from heaving relative to each other under unstable loading conditions and/or temperature fluctuations. When reinforcement member are cast to extend between these floor slabs, cracking and failure in the concrete may occur at the reinforcement member from horizontal movement between the slabs. Accordingly, to prevent this cracking, it is known to use pockets or sleeves with plates and bars that extend across joints between concrete slabs, where the pockets and sleeves allow the plates or bars to move in the pockets or sleeves.

SUMMARY OF THE PRESENT INVENTION

The present invention provides a floor dowel sleeve that receives a dowel plate that spans between and vertically supports concrete slabs at a seam between the concrete slabs, where the sleeve is configured to allow the dowel plate to move horizontally within the sleeve, such as from forces exerted by shifting or heaving of the concrete slabs. The floor dowel sleeve may have a rectangular-shaped cavity that is used to house a rectangular-shaped dowel that extends between two adjacent concrete floor slabs to maintain a level seam between the slabs. The dowel restricts vertical shear forces between the slabs; however, the sleeve allows horizontal movement (lateral and longitudinal) between the slabs, such as due to expansion or contraction of the concrete slabs. The sleeve is cast in one of the adjacent concrete slabs and the rectangular-shaped dowel is then inserted in the sleeve to allow an exposed end of the dowel to be cast into the other slab.

According to one aspect of the present invention, a floor dowel sleeve is provided for receiving a dowel plate that spans between and vertically supports concrete slabs at a seam between the concrete slabs. The floor dowel sleeve includes a rectangular-shaped body portion having four exterior side walls and an end wall that, together, surround a cavity. The cavity is configured to receive a dowel plate at an opening opposite the end wall of the body portion. A pair of break-away interior walls extend within the cavity from the opening to the end wall. The interior walls extend between two opposing (horizontal) walls of the exterior side walls and are continuously spaced from the other two opposing (vertical) walls of the exterior side walls. The body portion is configured to receive the dowel plate in the cavity between the break-away interior walls, where the break-away interior walls are configured to at least partially break-away from the exterior side walls upon lateral horizontal movement of the dowel plate within the cavity.

Optionally, the break-away interior walls may include weakened portions at or near at least one of upper and lower connection points with the horizontally-oriented opposing side walls, where the weakened portions are configured to break to allow the interior walls to break away from the body portion. Also, the body portion may be configured to space the dowel plate away from the end wall within the cavity, such as by providing crush members that protrude within the cavity from the end wall toward the opening of the cavity, where the crush members may be configured to collapse or compress toward the end wall upon longitudinal horizontal movement of the dowel plate. The crush members may protrude within the cavity from the end wall a distance generally less than a third of the distance between the opening and the end wall. Further, all or portions of the sleeve may be integrally formed as a single piece, such as a single, injection molded plastic piece.

According to another aspect of the present invention, a floor dowel sleeve assembly is provided that spans between and vertically supports concrete slabs at a seam between the concrete slabs. The floor dowel sleeve assembly includes a rectangular-shaped dowel plate having a first portion that is configure to be cast into a first concrete slab. A rectangular-shaped sleeve is also provided that has four exterior side walls and an end wall that together surround a cavity that has an end opposing the end wall, where the sleeve is configured to be cast into a second concrete slab adjacent to and forming a seam with the first concrete slab. A pair of break-away interior walls extend within the cavity at a spaced distance from lateral walls of the exterior side walls, where the interior walls integrally extend between opposing upper and lower walls of the exterior side walls. Crush members integrally protrude from the end wall within the cavity toward the opening. The second portion of the dowel plate is movably inserted in the cavity between the break-away interior walls and in abutting contact with the opposing upper and lower walls and a distal portion of the crush members, where the break-away interior walls are configured to break-away from the opposing upper and lower walls upon lateral horizontal movement of the dowel plate. The crush member are configured to compress toward the end wall upon longitudinal horizontal movement of the dowel plate.

These and other objects, advantages, purposes, and features of the present invention will become apparent upon review of the following specification in conjunction with the drawings.

DETAILED DESCRIPTION OF EMBODIMENTS

Figure 1:
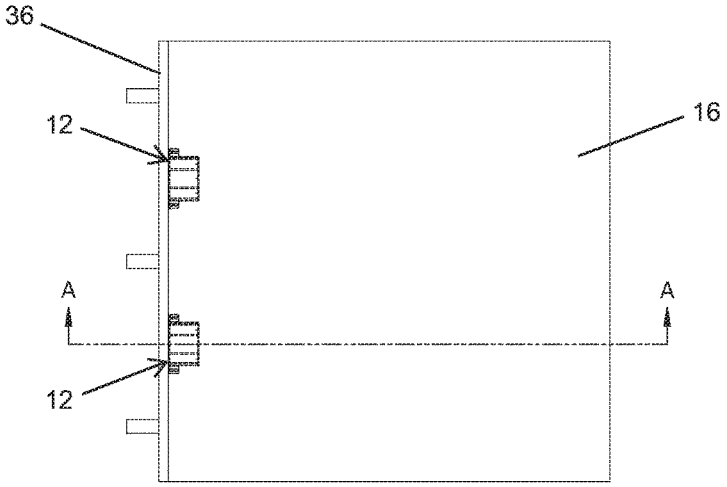
FIG. 1 is a top plan view of a concrete form having two floor dowel sleeves attached at an interior of the form and cast within the formed concrete slab, in accordance with the present invention.
Figure 1A:
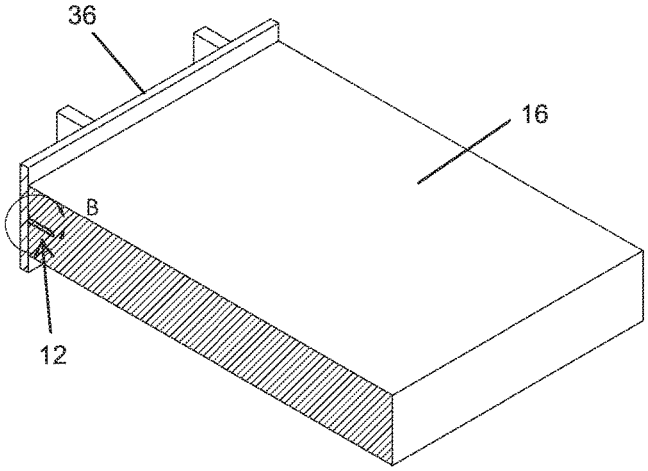
FIG. 1A is a cross-sectional upper perspective view of the concrete form and slab taken at section A-A in FIG. 1, showing the floor dowel sleeve cast within the concrete slab.

Referring now to the drawings and the illustrative embodiments depicted therein, a floor dowel sleeve assembly 10 (FIG. 3) is provided that includes a floor dowel sleeve 12 that receives a dowel plate 14 that spans between and vertically supports adjacent concrete slabs 16 at a seam between the adjacent concrete slabs to maintain a flush seam or desired level between the slabs. The dowel plate 14 has a substantially rectangular shape and a first rectangular portion that is cast into one of the concrete slabs, while a second rectangular portion of the dowel plate 14 is received in a rectangular-shaped cavity 18 of the floor dowel sleeve 12. Typically, prior to casting the first portion of the dowel plate 14 in concrete or inserting the dowel plate 14 in the sleeve 12, the floor dowel sleeve 12 is first cast in a concrete slab 16. The dowel plate 14 is then inserted in the sleeve 12 to allow an exposed end of the dowel to be cast into the other slab. The cast dowel then acts to restrict vertical shear forces between the slabs, while allowing horizontal movement in the sleeve cavity 18, such as due to expansion or contraction of the concrete slabs.

The floor dowel sleeve 12 includes a rectangular-shaped body portion 20 having four exterior side walls 22, 24, 26, 28 and an end wall 30 that, together, surround the cavity 18. The dowel sleeve 12 receives the dowel plate 14 at an opening 18*a* to the cavity 18 opposite the end wall 30 of the body portion 20. A pair of break-away interior walls 32 extend within the cavity 18 from the opening 18*a* to the end wall 30. The interior walls 32 extend vertically between two opposing (horizontal) exterior walls 22, 24 and are continuously spaced from the other two opposing (vertical) exterior walls 26, 28, so as to enclose outer areas 18*a*, 18*b* of the cavity between the interior walls 32 and the exterior walls 22, 24. The dowel plate 14 is received between the break-away interior walls 32, such that the break-away interior walls 32 are configured to at least partially break away from the exterior side walls 22, 24 upon lateral horizontal movement of the dowel plate within the cavity. Upon the interior walls 32 breaking away from the upper and lower side walls 22, 24, the dowel plate is permitted to move laterally into the out areas 18*a*, 18*b* of the cavity 18.

Figure 6:
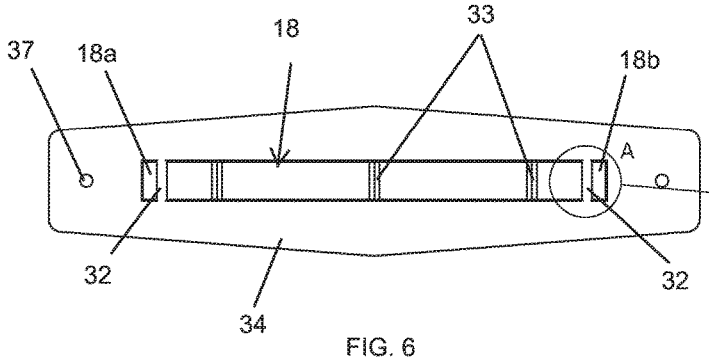
FIG. 6 is an end elevational view of the floor dowel sleeve illustrated in FIG. 4, having the dowel plate removed to show to the cavity.
Figure 6A:
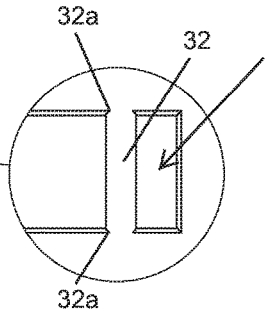
FIG. 6A is an enlarged view of an interior wall extending within the cavity of the floor dowel sleeve, taken at section A of FIG. 6.

The break-away interior walls 32 may include weakened portions 32*a* (FIG. 6A) at or near at least one of upper and lower connection points with the horizontally-oriented opposing side walls 22, 24. Such weakened portions are configured to break to allow the interior walls to break away from the body portion. For example, the weakened portions may comprise a narrowed area, a perforation, a loosely attached seam, or the like. As shown in FIGS. 6-6A, the cavity of the sleeve includes two break-away walls that extend integrally within the sleeve, and that are continuously spaced from the interior vertical side walls. The break-away walls 32 may be positioned to center the dowel in the sleeve and approximately equally space the dowel plate away from the exterior vertical side walls 22, 24 of the sleeve.

Figure 7:
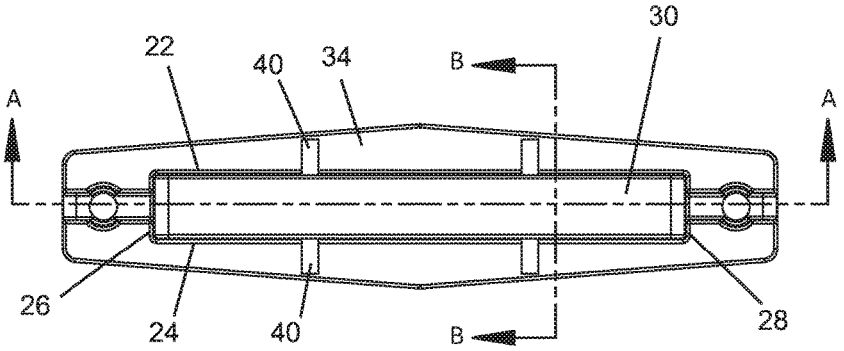
FIG. 7 is an end elevational view of the floor dowel sleeve shown in FIG. 4.
Figure 7A:
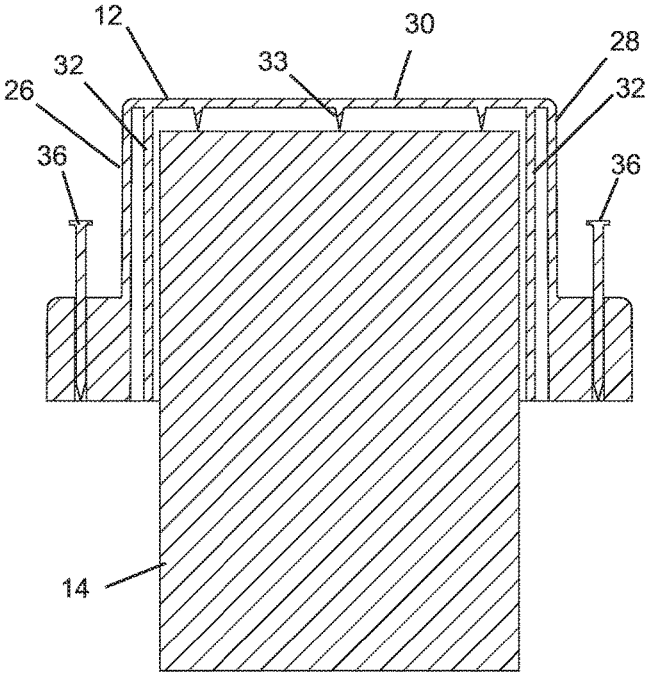
FIG. 7A is a cross-sectional view of the floor dowel sleeve and dowel plate inserted within the cavity of the sleeve, taken at line A-A of FIG. 7.
Figure 7B:
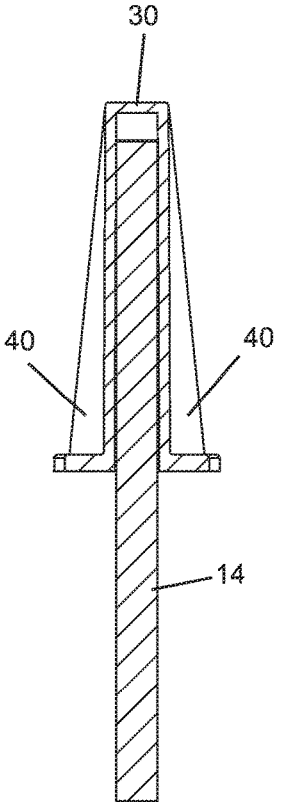
FIG. 7B is a cross-sectional view of the floor dowel sleeve and dowel plate inserted within the cavity of the sleeve, taken at line B-B of FIG. 7.
Figure 8:
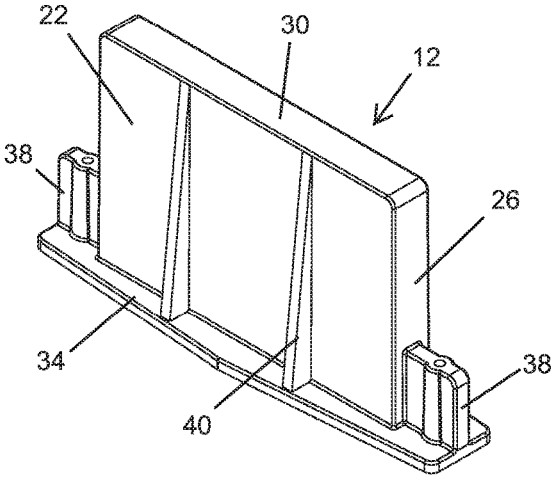
FIG. 8 is a perspective view of the floor dowel sleeve illustrated in FIG. 4, shown without the dowel plate in the sleeve.
Figure 9:
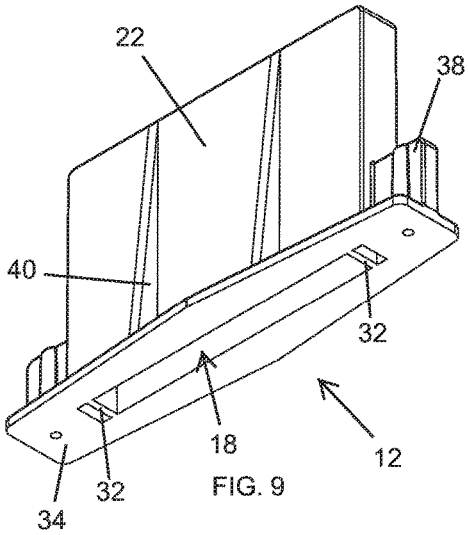
FIG. 9 is another perspective view of the floor dowel sleeve, taken from an opposing end of the sleeve from that illustrated in FIG. 8.
Figure 10:
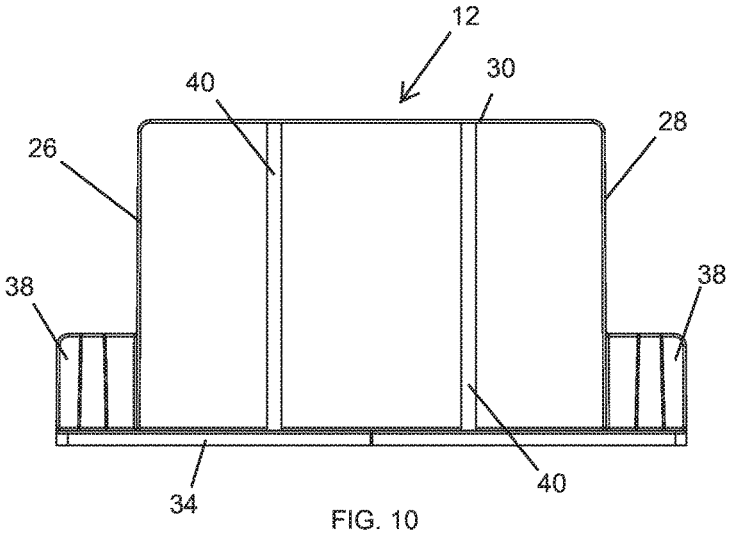
FIG. 10 is a side elevational view of the floor dowel sleeve illustrated in FIG. 8.
Figure 11:
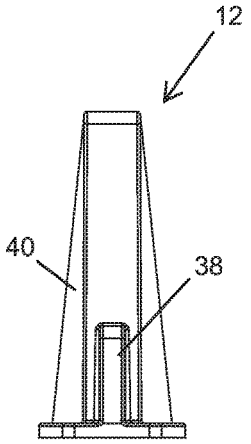
FIG. 11 is another side elevational view of the floor dowel sleeve illustrated in FIG. 8.
Figure 12:
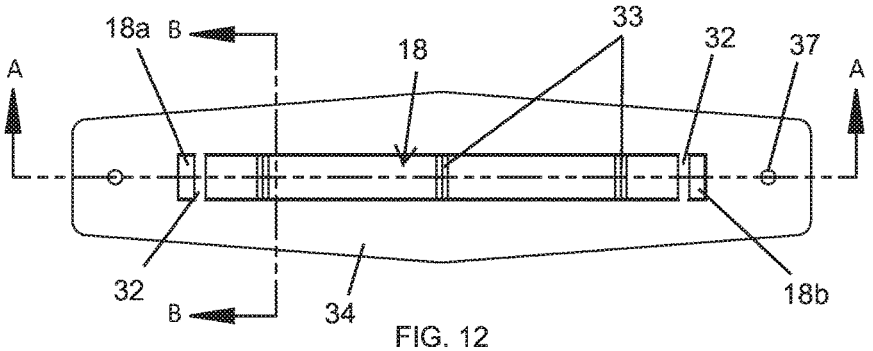
FIG. 12 is an end elevational view of the floor dowel sleeve illustrated in FIG. 8.
Figure 12A:
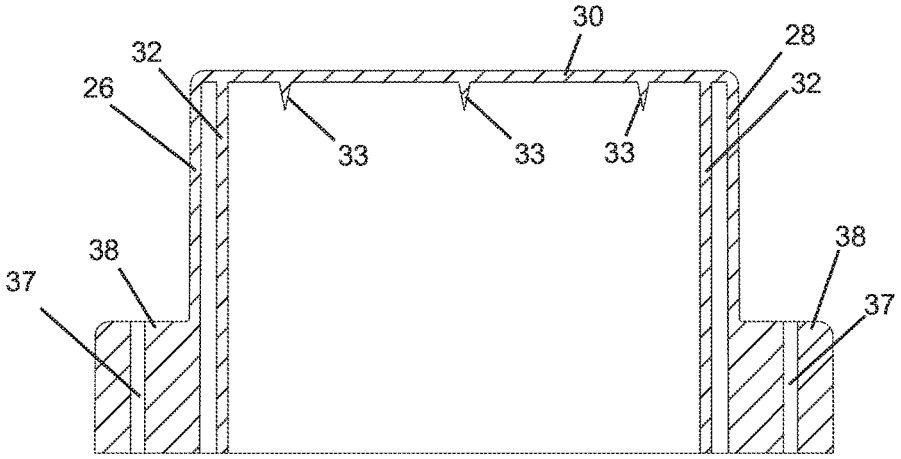
FIG. 12A is a cross-sectional view taken at line A-A of FIG. 12.
Figure 12B:
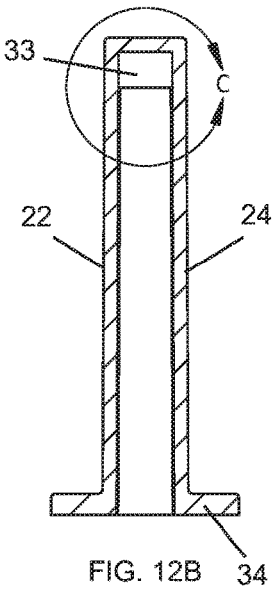
FIG. 12B is a cross-sectional view taken at line B-B of FIG. 12.
Figure 12C:
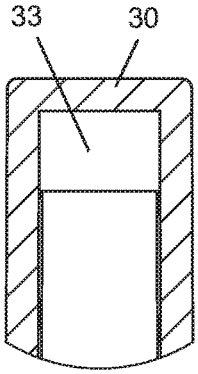
FIG. 12C is an enlarged view of a crush member extending from an end wall of the floor dowel sleeve, taken at section C of FIG. 12B.
Figure 13:
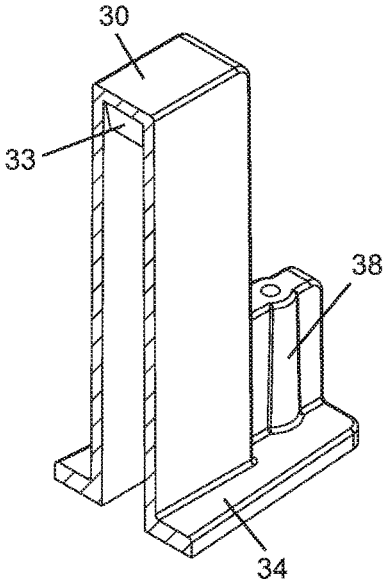
FIG. 13 is a cross-sectional perspective view of the floor dowel sleeve taken at line B-B of FIG. 12.

Also, the floor dowel sleeve 12 may be configured to space the dowel plate 14 away from the end wall 30 within the cavity, such as by providing a plurality of crush members 33 that protrude within the cavity 18 from the end wall 30 toward the opening 18*a* of the cavity. The plurality of crush members 33 may comprise crush ribs or spikes or the like that are each configured to collapse or compress toward the end wall 30 upon longitudinal horizontal movement of the dowel plate 14. As shown in FIG. 7A, the crush members or spikes have a v-shape and narrow to a point as they extend away from the end wall 30, such that they are configured to compress or crush toward the end wall 30 from horizontal forces exerted by the dowel plate 14 to allow for such movement of the dowel 14 within the sleeve 12 and corresponding movement between the slabs 16 on opposing sides of the seam. The plurality of crush members 33 may preferably protrude within the cavity 18 from the end wall 30 a distance generally less than a third of the distance between the opening 18*a* and the end wall 30, so the dowel plate does not become overly offset into one of the adjacent concrete slabs.

Figure 1B:
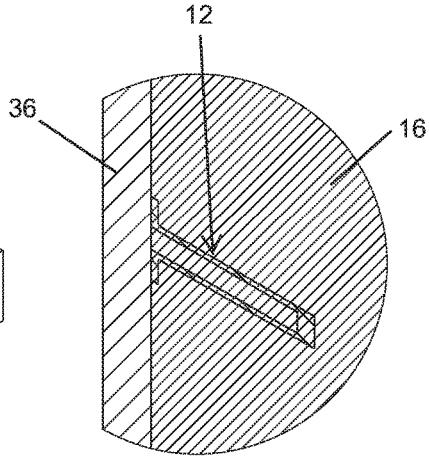
FIG. 1B is an enlarged view of the cross section of the floor dowel sleeve cast in the concrete slab, taken at section B of FIG. 1A.
Figure 2:
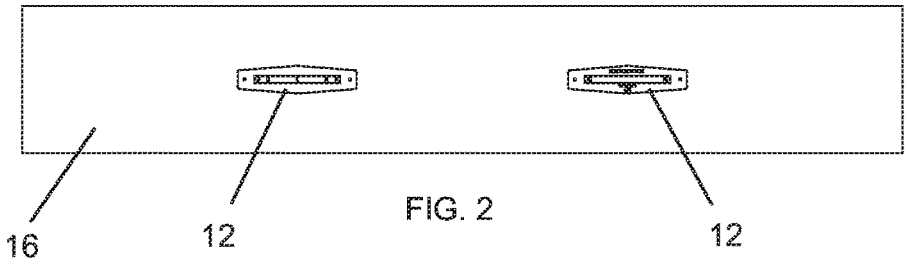
FIG. 2 is an end elevational view of the concrete slab and cast floor dowel sleeves illustrated in FIG. 1, after the concrete form is removed.

As shown, for example, in FIGS. 1-1B, the floor dowel sleeve 12 has a collar portion 34 that is temporarily attached to a wall 36 of a concrete form that at least partially surrounds the concrete floor slab 16 being cast. When attached at the illustrated concrete form, the dowel sleeve 12 is horizontally suspended to extend into the area surrounding the concrete form, such that once the concrete is poured, the sleeve 12 is disposed at an edge portion of the concrete slab. The illustrated collar portion 34 is integrally connected with the exterior side walls 22, 24, 26, 28 of the body portion 20 and extends continuously around the opening 18*a* of the cavity 18, such as shown in FIG. 6. Accordingly, when attached to the concrete form, the collar portion 34 is placed in substantially continuous contact with concrete form around the opening, such that concrete is permitted from entering the cavity 18. Optionally, when casting the sleeve 12 in the concrete slab, a piece of tape or similar film covering may be provided over the opening 18*a* of the cavity 18 to further prevent concrete from entering the cavity during the casting process. A logo and/or other indicia may also be provided on the collar 34 that surrounds the opening 18*a* to the cavity 18, so as to be visible after being cast, such as shown in FIGS. 2-3A.

Figure 4:
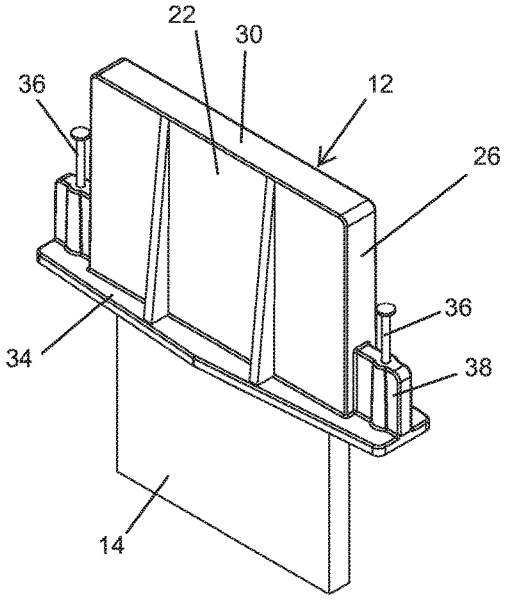
FIG. 4 is a perspective view of a floor dowel sleeve having a dowel plate inserted into a cavity of the sleeve.
Figure 5:
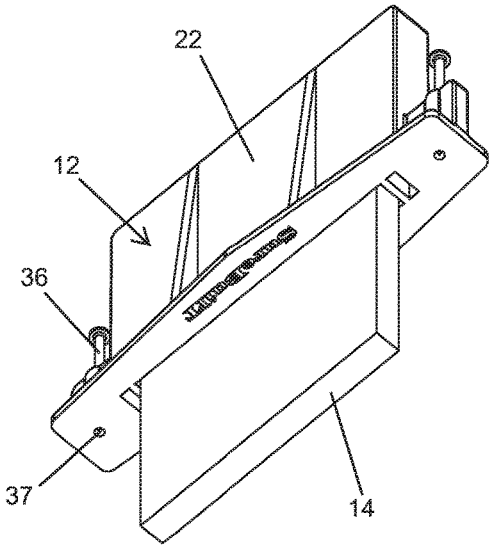
FIG. 5 is another perspective view of the floor dowel sleeve and dowel plate inserted into the sleeve, taken from an opposing end of the sleeve from that illustrated in FIG. 4.

The collar portion 34 may be attached to the concrete form with a fastener, such as the illustrated nails 36 or similar mechanical fasteners that extend through a hole 37 in an embossment 38 formed on the collar portion 23 (FIG. 4). The fastener embossment 38 may be formed to integrally interconnect with the exterior of the body portion 20 and to provide stiffening and support between the collar portion 34 and the body portion 20. The exterior surface of the sleeve 12 may also include stiffening flanges 40 that extend along the outer surface of the body portion 20 of the sleeve 12, from the collar portion 34 to the end wall 30 of the sleeve opposite the opening. The stiffening flanges 40 (FIG. 7) may extend perpendicular to the collar portion 34 and gradually taper in height, narrowing as they extend away from the collar portion 34. Also, additional reinforcements may be provide for stabilizing the sleeve in the concrete and preventing the cavity from collapsing, such as during the casting process.

Further, all or portions of the sleeve 12 may be integrally formed as a single piece, such as a single piece comprising at least one of a polymer, fiber composite, and metal material. As illustrated, the sleeve, including the breakaway walls, crush members or spikes, stiffening flanges, and the side reinforcements, are integrally formed from a single piece of rigid polymer, such as a single, injection molded plastic piece.

Figure 3:
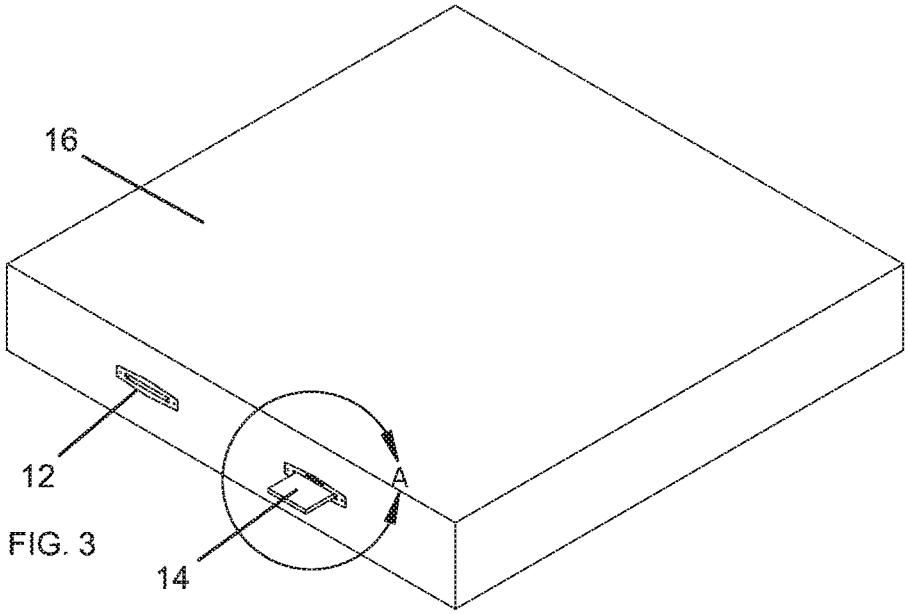
FIG. 3 is an upper perspective view of the concrete slab and cast floor dowel sleeves illustrated in FIG. 2, showing a dowel plate inserted into one of the floor dowel sleeves.
Figure 3A:
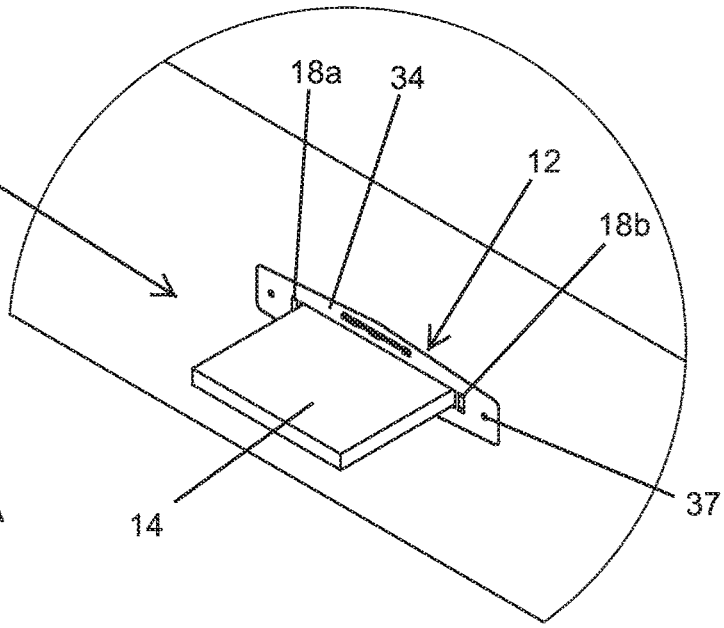
FIG. 3A is an enlarged view of the dowel plate inserted into the floor dowel sleeve, taken at section A of FIG. 3.

For purposes of this disclosure, the terms "upper," "lower," "right," "left," "rear," "front," "vertical," "horizontal," and derivatives thereof shall relate to the invention as oriented in FIG. 3. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A floor dowel sleeve for receiving a dowel plate that spans between and vertically supports concrete slabs at a seam between the concrete slabs, said floor dowel sleeve comprising:

a rectangular-shaped body portion having exterior side walls and an end wall that surround a cavity configured to receive a dowel plate at an opening opposite the end wall, wherein the exterior side walls include two longitudinal planar surfaces and transverse side edges that extend between the two longitudinal planar surfaces;

a pair of break-away interior walls that each have a transverse planar surface that extends continuously within the cavity from the opening to the end wall and extends vertically between the two longitudinal planar surfaces of the exterior side walls, wherein the break-away interior walls are continuously spaced from the transverse side edges of the exterior side walls to provide an elongated void extending along each of the transverse side edges from the end wall to the opening; and wherein the body portion is configured to receive the dowel plate in the cavity between the break-away interior walls, and wherein the break-away interior walls are configured to at least partially break-away from at least one of the two longitudinal planar surfaces upon lateral horizontal movement of the dowel plate within the cavity.

2. The floor dowel sleeve of claim 1, wherein the body portion is configured to space the dowel plate away from the end wall within the cavity.

3. The floor dowel sleeve of claim 1, further comprising a plurality of crush members that protrude within the cavity from the end wall a distance generally less than a third of the distance between the opening and the end wall, wherein the plurality of crush member are configured to collapse toward the end wall upon longitudinal horizontal movement of the dowel plate.

4. The floor dowel sleeve of claim 1, wherein at least one of the pair of break-away interior walls includes a weakened portion at or near at least one of upper or lower connection points with the two longitudinal planar surfaces, and wherein the weakened portion is configured to break to allow the corresponding break-away interior wall to break away from the corresponding longitudinal planar surface.

5. The floor dowel sleeve of claim 1, wherein the body portion and the pair of break-away interior walls are integrally formed as a single piece comprising polymer.

6. The floor dowel sleeve of claim 1, wherein the two longitudinal planar surfaces are substantially parallel with each other and substantially perpendicular with the transverse side edges of the body portion.

7. The floor dowel sleeve of claim 1, wherein the two longitudinal planar surfaces are disposed at a spacing from each other that provides a height of the cavity that is configured to contact upper and lower surfaces of the dowel plate received in the cavity.

8. The floor dowel sleeve of claim 1, wherein the rectangular-shaped sleeve comprises a collar portion that extends around the opening of the cavity and is integrally coupled with the exterior side walls, and wherein the collar portion is oriented substantially perpendicular to the exterior side walls.

9. The floor dowel sleeve of claim 8, wherein the rectangular-shaped body portion comprises at least one stiffening flange that extends longitudinally along an exterior surface of one of the exterior side walls from the collar portion toward the end wall.

10. A floor dowel sleeve for receiving a dowel plate that spans between and vertically supports concrete slabs at a seam between the concrete slabs, said floor dowel sleeve comprising:

a rectangular-shaped body portion having four exterior side walls and an end wall that surround a cavity configured to receive a dowel plate, wherein the four exterior side walls include two longitudinal planar surfaces and transverse side edges that extend between the two longitudinal planar surfaces;

a collar portion integrally coupled with the four exterior side walls of the body portion and extending around an opening of the cavity;

a pair of break-away interior walls that extend within the cavity from the opening to the end wall and extend between the two longitudinal planar surfaces of the exterior side walls, wherein the pair of break-away interior walls are continuously spaced from the transverse side edges of the exterior side walls;

a plurality of crush members disposed within the cavity and extending from the end wall a distance generally less than a third of the distance between the opening and the end wall; and wherein the cavity is configured to receive the dowel plate between the pair of break-away interior walls and in abutting contact with a distal portion of the plurality of crush members, wherein the pair of break-away interior walls are configured to break-away from at least one of the two longitudinal planar surfaces upon lateral horizontal movement of the dowel plate, and wherein at least one of the plurality of crush member are configured to collapse toward the end wall upon longitudinal horizontal movement of the dowel plate toward the end wall.

11. The floor dowel sleeve of claim 10, wherein at least one of the pair of break-away interior walls includes a weakened portion at or near at least one of the two longitudinal planar surfaces, and wherein the weakened portion is configured to break to allow the corresponding break-away interior wall to break away from the corresponding longitudinal planar surface.

12. The floor dowel sleeve of claim 10, wherein the body portion and the pair of break-away interior walls are integrally formed as a single piece.

13. The floor dowel sleeve of claim 10, wherein the collar portion extends substantially perpendicular to the four exterior side walls at the opening of the cavity for preventing the opening of the cavity from collapsing.

14. The floor dowel sleeve of claim 10, wherein the body portion, the collar portion, the pair of break-away interior walls, and the plurality of crush members are integrally formed as a single piece.

15. The floor dowel sleeve of claim 10, wherein the two longitudinal planar surfaces are separated from each other at a generally consistent spacing that is configured to contact upper and lower surfaces of the dowel place received in the cavity.

16. The floor dowel sleeve of claim 10, wherein the rectangular-shaped body portion comprises at least one stiffening flange that extends longitudinally along an exterior surface of one of the four exterior side walls from the collar portion toward the end wall.

17. A floor dowel sleeve assembly that spans between and vertically supports concrete slabs at a seam between the concrete slabs, said floor dowel sleeve assembly comprising:

a rectangular-shaped dowel plate having a first portion configure to be cast into a first concrete slab;

a rectangular-shaped sleeve having exterior side walls and an end wall that together surround a cavity that has an end opening at an opposing side of the cavity from the end wall, wherein the exterior side walls include two longitudinal planar surfaces and transverse side edges that extend between the two longitudinal planar surfaces, and wherein the sleeve is configured to be cast into a second concrete slab adjacent to and forming a seam with the first concrete slab;

a pair of break-away interior walls that extend longitudinally within the cavity from the end wall to the end opening of the cavity, wherein the break-away interior walls integrally extend between the two longitudinal planar surfaces of the rectangular-shaped sleeve, and wherein the pair of break-away interior walls are disposed at a spaced distance from the transverse side edges of the rectangular-shaped sleeve;

a plurality of crush members integrally protrude from the end wall within the cavity toward the end opening; and wherein a second portion of the dowel plate is movably inserted in the cavity between the pair of break-away interior walls and in abutting contact with the two longitudinal planar surfaces and a distal portion of the plurality of crush members, wherein at least one of the pair of break-away interior walls are configured to break-away from the two longitudinal planar surfaces upon lateral horizontal movement of the dowel plate, and wherein the plurality of crush member are configured to compress toward the end wall upon longitudinal horizontal movement of the dowel plate into the cavity.

18. The floor dowel sleeve assembly of claim 17, wherein the pair of break-away interior walls include a weakened portion at or near at least one of the two longitudinal planar surfaces.

19. The floor dowel sleeve assembly of claim 17, wherein the pair of break-away interior walls and the plurality of crush members are integrally formed with the rectangular-shaped sleeve as a single piece.

20. The floor dowel sleeve assembly of claim 17, wherein the rectangular-shaped sleeve comprises a collar portion that extends around the end opening of the cavity and is integrally coupled with the exterior side walls.

21. The floor dowel sleeve assembly of claim 20, wherein the rectangular-shaped sleeve comprises at least one stiffening flange that extends longitudinally along an outer surface of one of the exterior side walls from the collar portion toward the end wall.

* * * * *